US006019854A

United States Patent [19]

Thomas

[11] Patent Number: 6,019,854

[45] Date of Patent: Feb. 1, 2000

[54] THUMBLESS SNOW REMOVAL AND CLEANING PADDLE

[76] Inventor: George H. Thomas, 722 Koogler, Fairborn, Ohio 45324

[21] Appl. No.: 09/090,694

[22] Filed: Jun. 5, 1998

Related U.S. Application Data

[63] Continuation-in-part of application No. 08/748,285, Nov. 13, 1996, and a continuation-in-part of application No. 08/752,644, Nov. 18, 1996.

[51] Int. Cl.[7] ..... A47K 7/02

[52] U.S. Cl. ..... 134/6; 15/118; 15/227

[58] Field of Search ..... 15/118, 209.1, 15/227; 134/6

[56] References Cited

U.S. PATENT DOCUMENTS

| | | | |
|---|---|---|---|
| 671,130 | 4/1901 | Darden . | |
| 1,146,359 | 7/1915 | Smith . | |
| 1,507,707 | 9/1924 | Morganstern | 15/227 |
| 1,519,577 | 12/1924 | Easton, Jr. . | |
| 1,713,065 | 5/1929 | Williams . | |
| 2,505,409 | 4/1950 | Kirchner | 15/227 |
| 2,761,166 | 9/1956 | Connolly . | |
| 2,964,772 | 12/1960 | Crawford . | |
| 3,142,855 | 8/1964 | Gilchrist . | |
| 3,784,998 | 1/1974 | Jones, Sr. . | |
| 4,199,835 | 4/1980 | Heyer et al. . | |
| 4,670,930 | 6/1987 | Lu . | |
| 4,683,592 | 8/1987 | Strongwater . | |
| 4,797,967 | 1/1989 | Lengers . | |
| 4,893,372 | 1/1990 | Wenzel . | |
| 5,008,969 | 4/1991 | Jarrett . | |
| 5,010,617 | 4/1991 | Nelson . | |
| 5,140,785 | 8/1992 | Eleouet . | |
| 5,230,119 | 7/1993 | Woods et al. . | |
| 5,369,257 | 11/1994 | Gibbon . | |

FOREIGN PATENT DOCUMENTS

| | | |
|---|---|---|
| 1434159 | 2/1966 | France . |
| 2530940 | 2/1984 | France . |
| 1029136 | 4/1958 | Germany . |
| 114265 | 3/1918 | United Kingdom . |

*Primary Examiner*—Terrence R. Till
*Attorney, Agent, or Firm*—Maginot, Addison & Moore

[57] ABSTRACT

This disclosure is directed to a thumbless snow removal and cleaning paddle of generally pentagonal configuration which encloses the user's entire hand, fits snugly around the wrist, is reversible during use, contains a moisture penetration resistant outer layer of greater size and extent elastically fastened on its inner side to the outer portion of a substantially symmetrical inner layer of lesser size and extent approximately one major surface of which (dorsal or plantar) is composed of natural or synthetic chamois material with the remaining major surfaces being composed of absorbent, soft cloth material.

19 Claims, 3 Drawing Sheets

THUMBLESS SNOW REMOVAL AND CLEANING PADDLE

This application is a continuation-in-part of co-pending application Ser. No. 08/748,285 filed on Nov. 13, 1996 and a continuation-in-part of co-pending application Ser. No. 08/752,644, filed on Nov. 18, 1996.

BRIEF DESCRIPTION OF THE INVENTION

The present invention is directed to a thumbless snow removal and cleaning paddle of generally pentagonal configuration which encloses the user's entire hand, fits snugly around the wrist, is reversible during use, contains a moisture penetration resistant outer layer of greater size and extent elastically fastened on its inner side to the outer portion of a substantially symmetrical inner layer of lesser size and extent, approximately one major surface of which (dorsal or plantar) is composed of natural or synthetic chamois material with the remaining major surface being composed of absorbent, soft cloth material.

BACKGROUND OF THE INVENTION AND PRIOR ART

To those living in climates experiencing snowfall during a portion of the year, it is occasionally necessary to remove snow from the windshield and glass of vehicles, such as automobiles and pick-up trucks, thereafter removing water and other moisture from the glass surfaces to enhance the driver's vision during operation of the vehicle.

It is also desirable to protect the hand of the person removing the snow and cleaning the glass from the low temperatures encountered during such tasks and to prevent actual physical damage to the fingers and hand of the person conducting these operations. It is likewise desirable to keep the hand and fingers of the user warm while using the device in cold weather such as accompanies the presence of snow.

There have been many attempts in prior art patents to come up with a cleaning device to accomplish the aforementioned combination of desired objectives, but non have done so as successfully as the present invention.

U.S. Pat. No. 4,670,930 issued Jun. 9, 1987 to Po-Ming Lu, is directed to a cleaning glove devoid of stitching that is configured into a pocket shape, has bristles or brushes (2) on its outside surface and has an opening for receiving the user's hand. The opening is smaller than the pocket body and is stated to prevent the user's hand from slipping out of the glove. The glove has outer front and backside surfaces made from different kinds of material, so as to clean different dirty surfaces. At least one of the outerside surfaces has an elastic, uniform directional, slant-angled brush or bristles for cleaning textured surfaces.

U.S. Pat. No. 4,683,592, issued Aug. 4, 1987 to Murray Strongwater, is directed to a combination ice scraper and mitt which includes an ice scraper (14) formed by an elongated member having a hand grip section and an opposite scraping end with a beveled scraping edge, the elongated member tapering down in width from the scraping end toward the hand grip section; a hook engaging material (40, 42) secured to the ice scraper; a mitt (12) positioned about the hand grip section, the mitt including a first end having an opening (32) to permit insertion of a hand of a user, a second end having an opening (36) for insertion of the hand grip section of the ice scraper, and an inner lining made of a thermal insulating material, to provide warmth to the hand of the user; a hook engageable material secured to the lining inside the mitt, immediately inwardly of the opening in the second end of the mitt, for engagement with the hook engaging material secured to the ice scraper so as to removably secure the ice scraper to the mitt; and an elastic band secured to the mitt in surrounding relation to the opening in the second end for causing the mitt to hug the scraper at the opening in the second end to substantially prevent cold air, snow and ice from entering the mitt and to provide increased securement of the mitt to the ice scraper.

U.S. Pat. No. 5,369,257, issued Nov. 29, 1994 to Robert M. Gibbon, is directed to a windshield deicing and defrosting mitt using microwave energy heating and a method of its use. The apparatus for removing frozen water from a vehicle glass includes a cured, microwave-heatable layer which may be formed from at least one elastomeric gum, a curing catalyst adaptable to cure the gum, and microwave-heatable particulate matter dispersed in the gum. In one embodiment, the apparatus is a mitt including an insulative layer which is positioned to be interposed between an inner surface of the elastomeric pad and the hand, such that the hand does not undergo temperature stress. The mitt also preferably includes a visual marker to indicate the temperature of the elastomeric pad.

U.S. Pat. No. 5,008,969 issued Apr. 23, 1991 to Guy R. Jarrett, is directed to a separable multi-layered wiping mitten to be worn by the human hand for wiping surfaces prior to painting whereby the outer concentric layer of the mitten may be removed as it becomes soiled and the wiping operation may be continued with successive concentric clean layers of the mitten.

U.S. Pat. No. 4,797,967 issued Jan. 17, 1989 to Hans L. Lengers is directed to a padded general purpose mitten and method of fabricating it. The general purpose cleaning and polishing mitten is fabricated from a tubular fabric blank by seaming one end closed, filling the blank with padding, forming another seam adjacent to the padding to enclose it, everting the remaining extent of the blank over the padded extent and forming a partial longitudinal seam from the transverse seam, thereby forming interior hand pockets with fingertip areas at opposite sides of the padding.

U.S. Pat. No. 4,893,372 issued Jan. 16, 1990 to Ronald E. Wenzel, is directed to a free-hand towel of tubular shape which has at its upper end an elastic band for encircling and gripping a user's arm at a location above or slightly below the elbow and has an enlarged lower end portion that drapes loosely over the user's hand and can be reverse-folded over the upper end portion to uncover the hand. The lower end portion can be secured in retracted position over the tubular upper end portion of the towel by inter-engagement of coating patches of a hook-and-pile fastener, one being located near the upper end of the towel and the other being located near the lower end of the towel.

It will be observed that none of the foregoing prior art patents contains the combined structural features which result in the attainment of the combination of objectives achieved in accordance with the present invention.

DETAILED DESCRIPTION OF THE INVENTION

Figure 1:
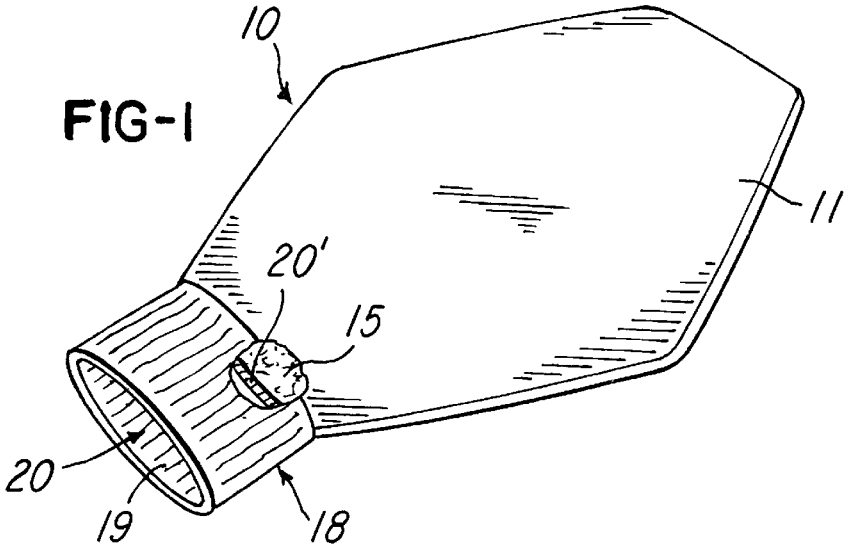
FIG. 1 of the drawings is directed to a perspective view of the thumbless, snow removal and cleaning paddle (10) of the present invention.

As is apparent from the figures of the drawings, thumbless snow removal and cleaning paddle (10) has a cuff member or wristlet (18) containing an elastic band (19) which is incorporated into the entrance opening (20) through which access is obtained into (10). The term "thumbless" as used herein indicates the absence of a discrete, separate thumb member on snow removal and cleaning paddle (10).

Substantially symmetrical inner layer (12) is divided longitudinally into two hemispheres, one composed of natural or synthetic chamois material (15) on either the dorsal or plantar major surface with the remaining major surface (14) being composed of absorbent, soft cloth material, including, but not necessarily limited to, blanket-type material which can be natural, synthetic, or a blend of natural and synthetic soft cloth. Inner layer (12) has an upstanding ledge ($L_1$) to which the lower portion of (13) is secured.

Figure 2:
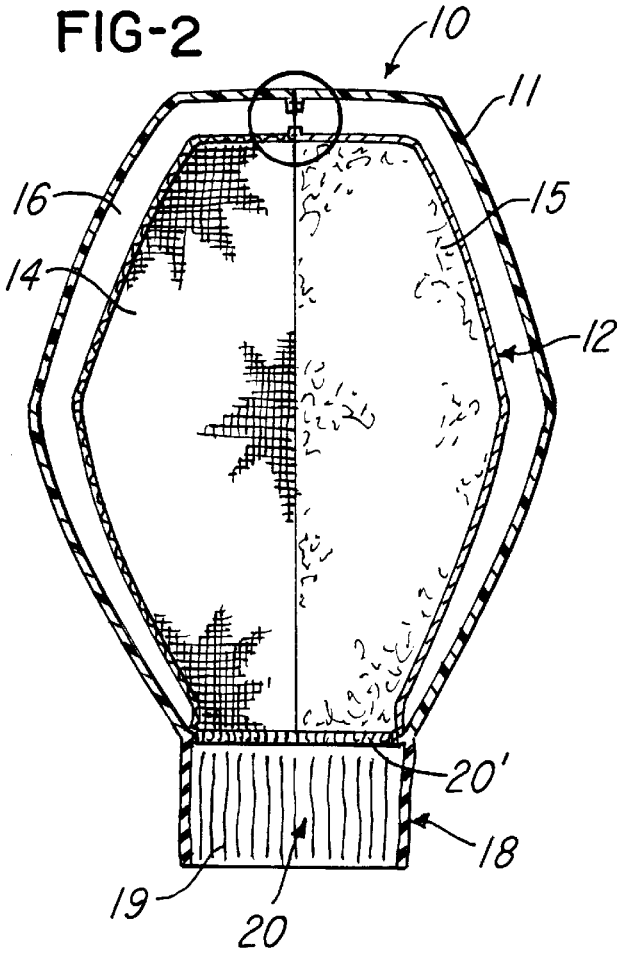
FIG. 2 is an isometric view of the paddle (10) with layers in sections showing the dorsal (14) and plantar (15) hemispheres of the device of this invention with the means (13) for joining the outer layer (11) to the inner layer (12). Space (16) in each branch of the pentagonal configuration provides some insulation from the cold.
Figure 3:
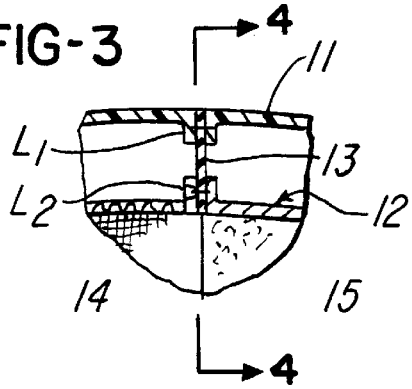
FIG. 3 is an enlarged isolated view from the perspective (17) of FIG. 2 illustrating in cross-sectional detail the manner of joining the outer layer (11) with the inner layer (12).
Figure 4:
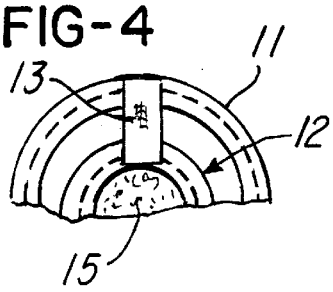
FIG. 4 is a cross-sectional view taken along the lines 4—4 of FIG. 3 and shows the plan (flat) extent of elastic fabric member (13).

As is more readily apparent from FIGS. 2, 3, and 4, loose, elastic fabric member (13) upper portion is fastened to and hence joins elastically the moisture resistant outer layer (11) at the downstanding ledge ($L_2$) of outer layer (11). It should also be observed that in the vicinity of the wrist portion (18) of snow removal and cleaning paddle (10), layers (11), (12) and (19) are joined by one or more lines of serge-type stitching (20). See FIGS. 2, 6 and 7.

Serge-type stitching is preferably used in accordance with the present invention wherever stitching is employed. For example serge-type stitching is used join the cuff of the main body inner and outer layers of the paddle where the paddle lower portions, both outer and inner, join the wrist portion. It is considered by many to represent a form of overcast stitch.

Figure 5:
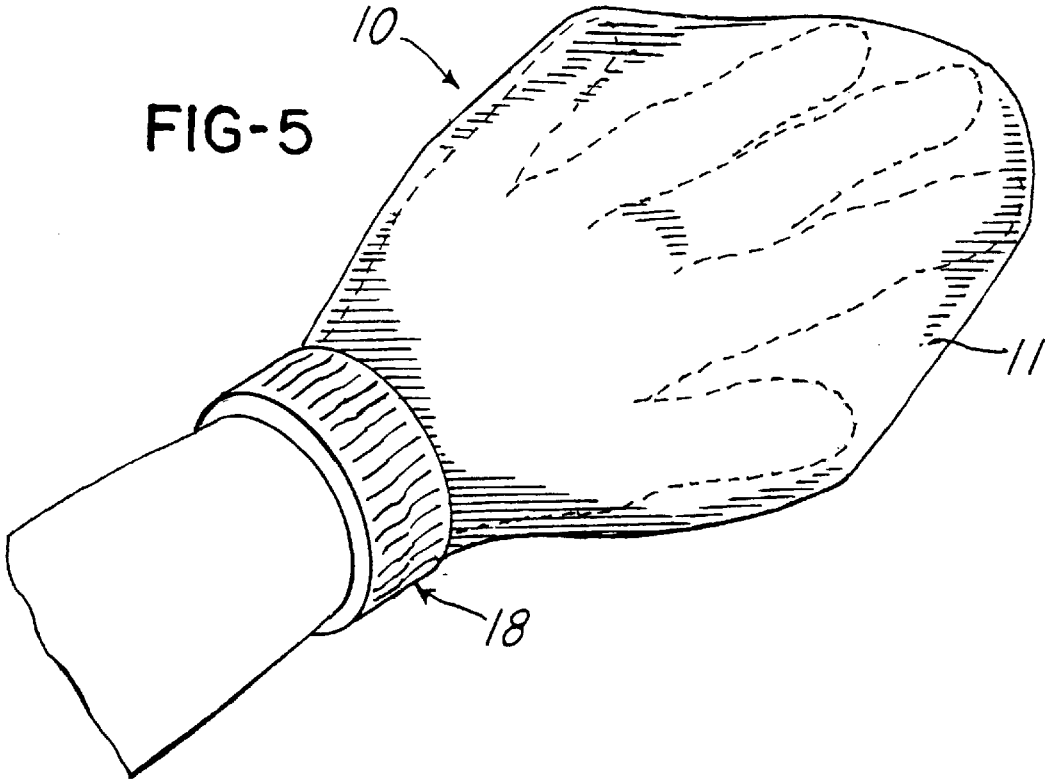
FIG. 5 is a perspective view of the device of this invention with the fingers of one hand shown in phantom line inserted into the thumbless snow removal and cleaning paddle.

The device of the present invention is utilized by inserting the user's hand, including all fingers, through the elastic band cuff or wristlet (18) into the device in a position roughly shown in FIG. 5 of the drawings. The device is utilized to brush the snow from the vehicle glass surfaces using the highly flexible woven or non-woven moisture penetration resistant outer layer (11).

Figure 6:
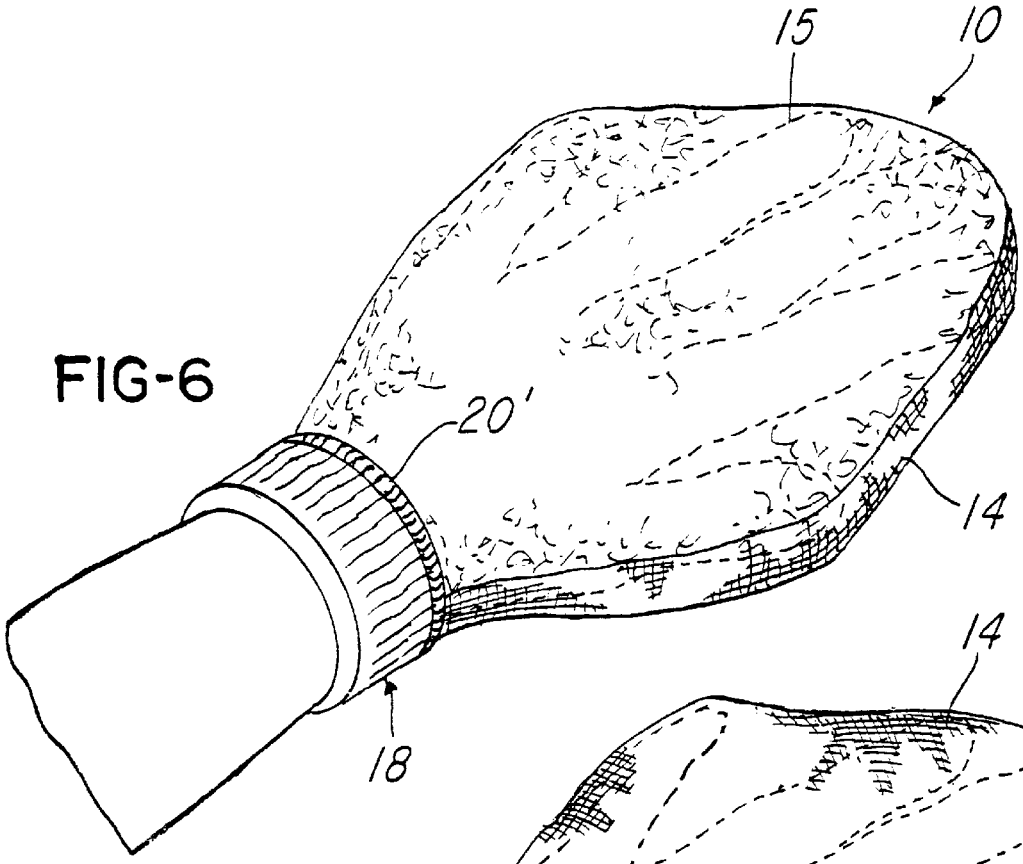
FIG. 6 is a perspective view of the device of this invention similar to that of FIG. 5 but inverted (turned inside out) to show the chamois hemisphere side (15) of the device downwardly, viz., beneath the plantar side of the user's hand.
Figure 7:
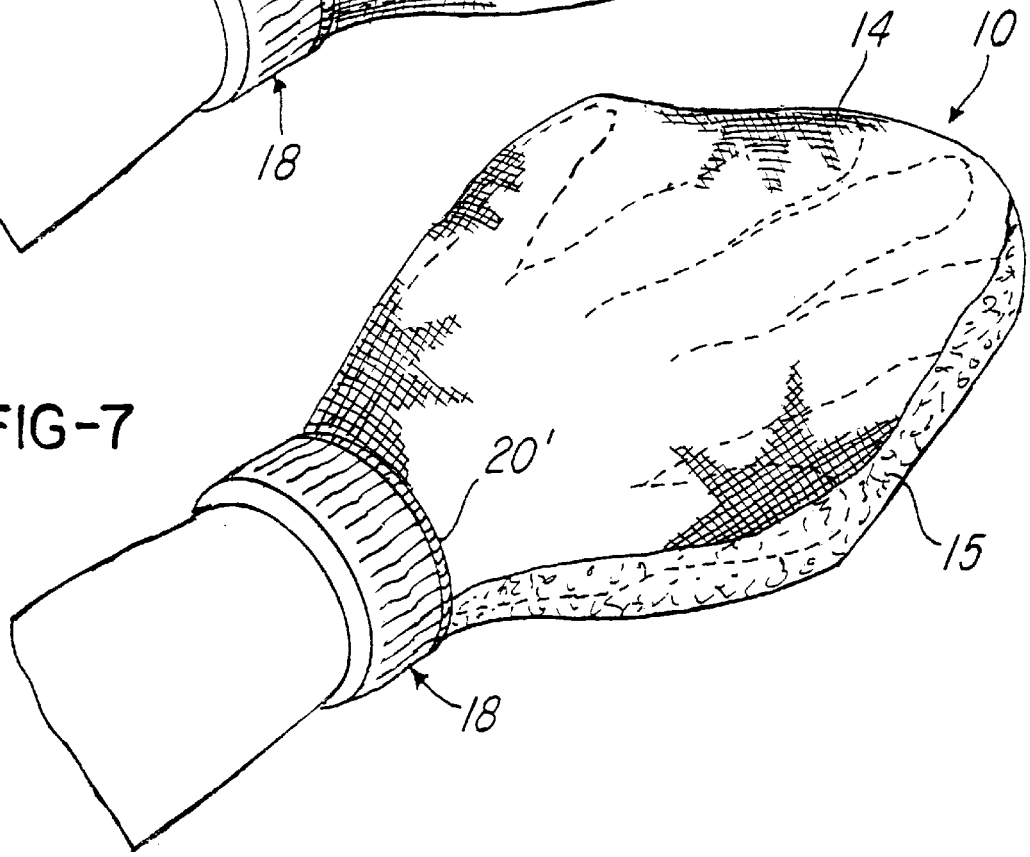
FIG. 7 is a perspective view similar to that of FIG. 6 but showing the user's plantar hand surface in contact with the absorbent soft cloth hemisphere portion (14) of the device.

After having accomplished this throughout the vehicle glass exterior surfaces; the loose snow, including some water, is shaken or brushed from the outer surface (11) and the device is turned inside out to permit access to the exterior major surfaces (14) and (15). With the hand reinserted as shown in FIGS. 6 and 7, the desired major surfaces are then used to clean and/or dry the major glass surfaces on the vehicle.

Paddle (10), when so inverted, can be used also to remove moisture vapor, frost, etc., from vehicle glass and wherever glass surfaces are present whether on vehicles or elsewhere.

What is claimed is:

1. A cleaning paddle, comprising:

an outer layer having a first void defined therein; and an inner layer positioned within said first void of said outer layer, wherein (1) said inner layer has a second void defined therein for receiving a user's hand, (2) said inner layer includes a first fabric segment which is exposed to said second void of said inner layer, and (3) said inner layer further includes a second fabric segment which is exposed to said second void of said inner layer, wherein said first fabric segment is made of material which is different relative to said second fabric segment.

2. The cleaning paddle of claim 1, wherein:

said outer layer defines a first enclosure having said first void therein, said inner layer defines a second enclosure having said second void therein, said second enclosure is positioned within said first void of said first enclosure, and said user's hand is positionable within said second void of said second enclosure.

3. The cleaning paddle of claim 1, wherein:

said outer layer is made of material which is different relative to said first fabric segment, and said outer layer is made of material which is different relative to said second fabric segment.

4. The cleaning paddle of claim 1, further comprising:

a first ledge attached to said outer layer;

a second ledge attached to said inner layer; and an attachment member secured to said first ledge and said second ledge such that said outer layer is secured to said inner layer.

5. The cleaning paddle of claim 4, wherein:

a space is defined between said outer layer and said inner layer, said first ledge is attached to said outer layer such that said first ledge extends into said space, said second ledge is attached to said inner layer such that said second ledge extends into said space, and said attachment member includes an elastic material.

6. The cleaning paddle of claim 1, wherein said outer layer has an opening defined therein, further comprising:

a cuff attached to said outer layer such that said cuff surrounds said opening.

7. The cleaning paddle of claim 1, wherein said first fabric includes a chamois material.

8. The cleaning paddle of claim 7, wherein said second fabric includes a cloth material.

9. A method of cleaning a windshield, comprising the steps of:

providing a cleaning paddle which includes an outer layer and an inner layer, wherein said inner layer includes (1) a first fabric segment, and (2) a second fabric segment, said first fabric segment being made of material which is different relative to said second fabric segment;

orienting said cleaning paddle so that said inner layer is positioned within a first interior space defined by said outer layer;

wiping said windshield with said outer layer while said inner layer is positioned within said first interior space defined by said outer layer;

inverting said cleaning paddle so that said outer layer is contained within a second interior space defined by said inner layer; and wiping said windshield with said first fabric segment of said inner layer while said outer layer is positioned within said second interior space defined by said inner layer.

10. The method of claim 9, wherein:

said outer layer is made of material which is different relative to said first fabric segment, and said outer layer is made of material which is different relative to said second fabric segment.

11. The method of claim 9, wherein said first fabric includes a chamois material.

12. The method of claim 11, wherein said second fabric includes a cloth material.

13. The method of claim 9, wherein:

the step of wiping said windshield with said outer layer includes the step of inserting a user's hand into said first interior space defined by said outer layer.

14. The method of claim 9, wherein:

the step of wiping said windshield with said inner layer includes the step of inserting a user's hand into said second interior space defined by said inner layer.

15. A cleaning apparatus, comprising:

an outer layer defining a first void therein;

a first ledge positioned within said first void and attached to said outer layer;

an inner layer positioned within said first void;

a second ledge positioned within said first void and attached to said inner layer; and an attachment member secured to said first ledge and said second ledge such that said outer layer is secured to said inner layer, wherein said attachment member includes an elastic material.

16. A cleaning apparatus, comprising:

an outer layer defining a first void therein;

a first ledge positioned within said first void and attached to said outer layer;

an inner layer positioned within said first void;

a second ledge positioned within said first void and attached to said inner layer; and an attachment member secured to said first ledge and said second ledge such that said outer layer is secured to said inner layer, wherein said inner layer includes (1) a first fabric segment, and (2) a second fabric segment, said first fabric segment being made of material which is different relative to said second fabric segment, wherein a space is defined between said inner layer and said outer layer, and wherein said first fabric segment and said second fabric segment are each exposed to said space.

17. A cleaning apparatus, comprising:

an outer layer defining a first void therein;

a first ledge positioned within said first void and attached to said outer layer:

an inner layer positioned within said first void;

a second ledge positioned within said first void and attached to said inner layer; and an attachment member secured to said first ledge and said second ledge such that said outer layer is secured to said inner layer, wherein said first fabric segment is made of material which is different relative to said second fabric segment, wherein said outer layer is made of material which is different relative to said first fabric segment, and wherein said outer layer is made of material which is different relative to said second fabric segment.

18. The apparatus of claim 17, wherein said first fabric includes a chamois material.

19. The apparatus of claim 18, wherein said second fabric includes a cloth material.

* * * * *